US006887089B2

(12) United States Patent
Nishide

(10) Patent No.: US 6,887,089 B2
(45) Date of Patent: May 3, 2005

(54) LEVER-TYPE CONNECTOR AND METHOD OF CONNECTING IT

(75) Inventor: Satoru Nishide, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/752,322

(22) Filed: Jan. 6, 2004

(65) Prior Publication Data

US 2005/0003689 A1 Jan. 6, 2005

(30) Foreign Application Priority Data

Jul. 1, 2003 (JP) ..... 2003-001520

(51) Int. Cl.[7] ..... H01R 13/62
(52) U.S. Cl. ..... 439/157; 439/372
(58) Field of Search ..... 439/157, 158–160, 439/342, 376, 372, 923

(56) References Cited

U.S. PATENT DOCUMENTS 5,954,528 A 9/1999 Ono et al.
5,975,929 A 11/1999 Matsuura et al.
6,254,414 B1 7/2001 Sawayanagi et al.
6,276,948 B1 * 8/2001 Okabe ..... 439/157
6,315,585 B1 * 11/2001 Oka ..... 439/157
6,739,889 B1 * 5/2004 Daggett et al. ..... 439/157
2001/0053623 A1 12/2001 Fukamachi
2002/0019160 A1 2/2002 Takata
2004/0058574 A1 3/2004 Nishide
2004/0077197 A1 4/2004 Nishide

* cited by examiner

*Primary Examiner*—Renee Luebke
*Assistant Examiner*—James R. Harvey
(74) *Attorney, Agent, or Firm*—Gerald E. Hespos; Anthony J. Casella

(57) ABSTRACT

A moving side connector (30) has a housing (31) with a receptacle (32). Male terminal fittings (33) are mounted in the housing (31) and have tabs (33*a*) that project into the receptacle (32). A waiting side connector (20) has a mating housing (21) that can fit in the receptacle (32). Levers (38) are supported rotatably on the male housing (31). A cam pin (40) is provided at an end of each lever (38) and is supported slidably in a corresponding cam groove (47) of a frame (46). A moving plate (35) is mounted in the receptacle 32 for movement along a connection direction (CD). The moving plate (35) has positioning holes (42) for positioning the tabs (33*a*) and cam pins (44) that engage cam grooves (39) of the levers (38) together with cam pins (24) of the mating housing (21).

14 Claims, 11 Drawing Sheets

LEVER-TYPE CONNECTOR AND METHOD OF CONNECTING IT

BACKGROUND OF THE INVENTION

1. Field of the Invention

The invention relates to a lever-type connector and to a method of connecting it with a mating connector.

2. Description of the Related Art

U.S. Pat. No. 6,254,414 discloses a connector that has a female housing and a lever that is supported rotatably on an outer side surface of the female housing. One end of the lever has a pin that is engaged with a supporting groove in a supporting member. The other end of the lever has a cam groove that engages a cam pin on an inner surface of a receptacle of a mating male housing. A connection resistance exists between the two housings as the housings are being connected and causes the female housing to approach the supporting member. Thus, the pin is displaced in the supporting groove and the lever is rotated. The cam pin of the male housing is engaged with the cam groove of the lever. Accordingly, the male housing is pulled into the female housing as the lever is rotated.

Male terminal fittings are accommodated in the male housing and have tabs that project into the receptacle. The tabs are intended to contact female terminal fittings in the female housing. However, a male terminal filting may be inclined in the male housing so that the leading end of the tab is displaced. Such an inclination may cause a connection problem with the female terminal fitting.

The present invention was developed in view of the above problem and an object thereof is to establish a good connection between a terminal fitting and a mating terminal fitting.

SUMMARY OF THE INVENTION

The invention relates to a lever-type connector with a housing for accommodating at least one terminal fitting that can contact at least one mating terminal fitting. The housing is connectable with a mating housing. At least one lever is supported rotatably on the housing. The lever has at least one cam means and a supportable portion. The cam means is engageable with a mating cam means on the mating housing. The supportable portion of the lever is supported movably on a supporting portion of a supporting member to permit rotation of the lever as the housings are connected. The housing is displaced to approach the supporting member and the supportable portion is moved with respect to the supporting portion to rotate the lever. Thus, the cam means engages the mating cam means and exhibits a cam action. A moving plate is mounted to the housing for movement forward and back substantially along a connecting direction. The moving plate has at least one positioning hole for receiving and positioning the terminal fittings.

The terminal fittings in the housing are introduced through the positioning holes of the moving plate and hence are positioned. The two housings then are connected in this state. Accordingly, the housing is displaced to approach the supporting member and the supportable portion is moved on the supporting portion to rotate the lever. The mating cam means of the mating housing engages the cam means and exhibits a cam action as the lever is rotated. Thus, the mating housing and the moving plate are pulled into the housing and the terminal fittings are brought into contact with the mating terminal fittings.

The moving plate preferably has at least one moving plate cam means that engages the cam means for moving the moving plate forward and backward in the housing as the lever is rotated.

The terminal fittings are positioned beforehand by the moving plate. Thus, a good connection can be established between the terminal fittings and the mating terminal fittings. Further, the moving plate preferably is moved forward and backward on the housing as the lever is rotated. Therefore, the moving plate is moved back to a starting position when the lever is rotated for separating the housings. Accordingly, the moving plate need not be repositioned when connecting the housings again and operability is better.

The housing preferably has a receptacle that substantially surrounds the terminal fittings and into which a mating connector housing is fittable.

The moving plate preferably is mounted in the receptacle for movement forward and backward substantially along a connecting direction.

The at least one cam means preferably is at one end of the lever, whereas the supportable portion preferably is at the other end of the lever.

The housing preferably is displaced to approach the supporting member and the supportable portion preferably is slid on the supporting portion to rotate the lever as the housings are connected.

A rotary shaft of the lever preferably is at a position on a lever-mounting surface of the housing displaced from the middle along a direction at an angle to the connecting direction. Accordingly, a distance from the rotary shaft to the supportable portion is long as compared to a case where the rotary shaft of the lever is at a middle of the lever-mounting surface. Thus, a force to rotate the lever and to connect the two housings can be reduced.

A distance from the rotary shaft to the supportable portion preferably exceeds a maximum distance from the rotary shaft to the cam means.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 3:
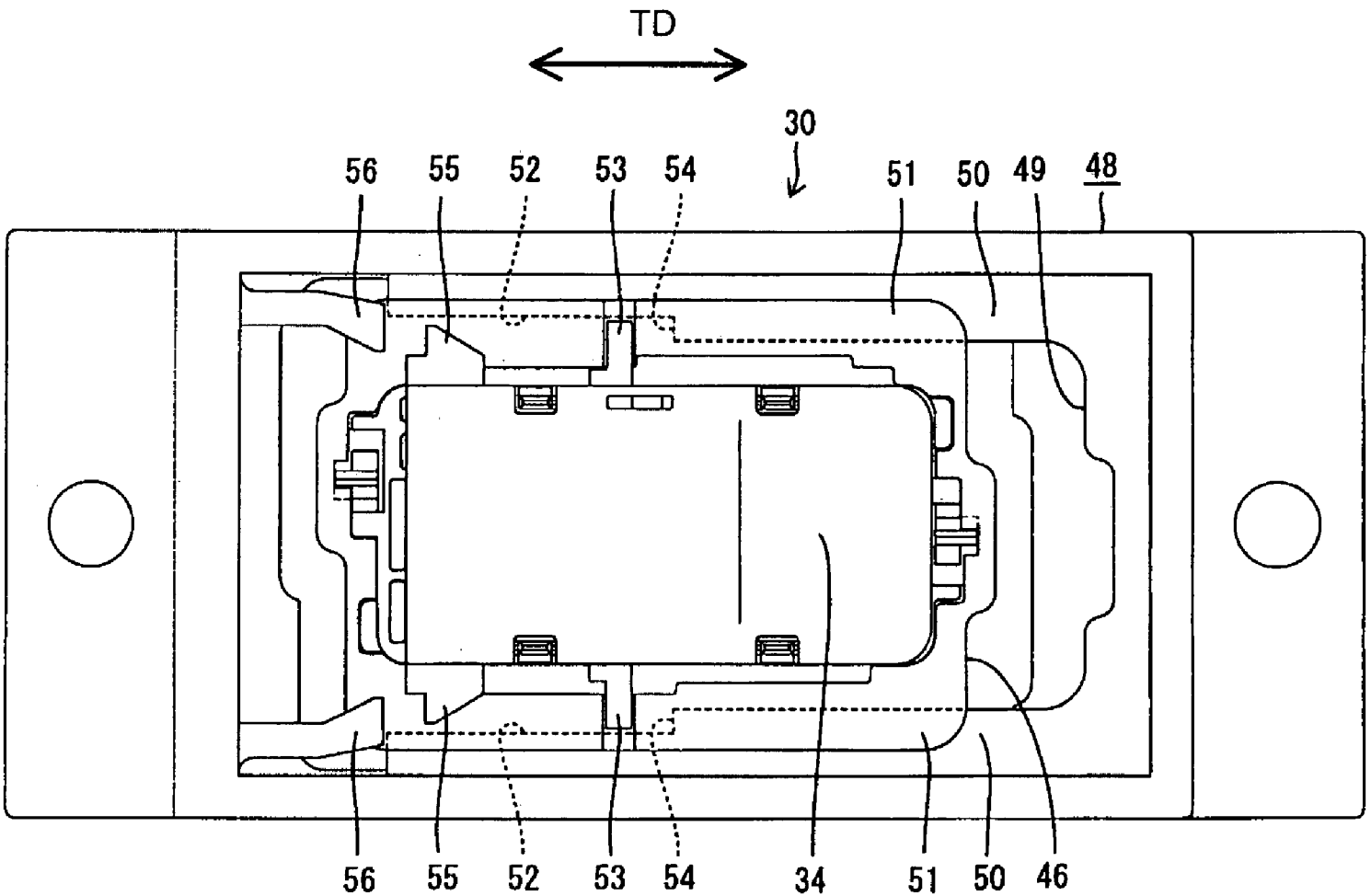
FIG. 3 is a rear view of the moving-side connector.
Figure 4:
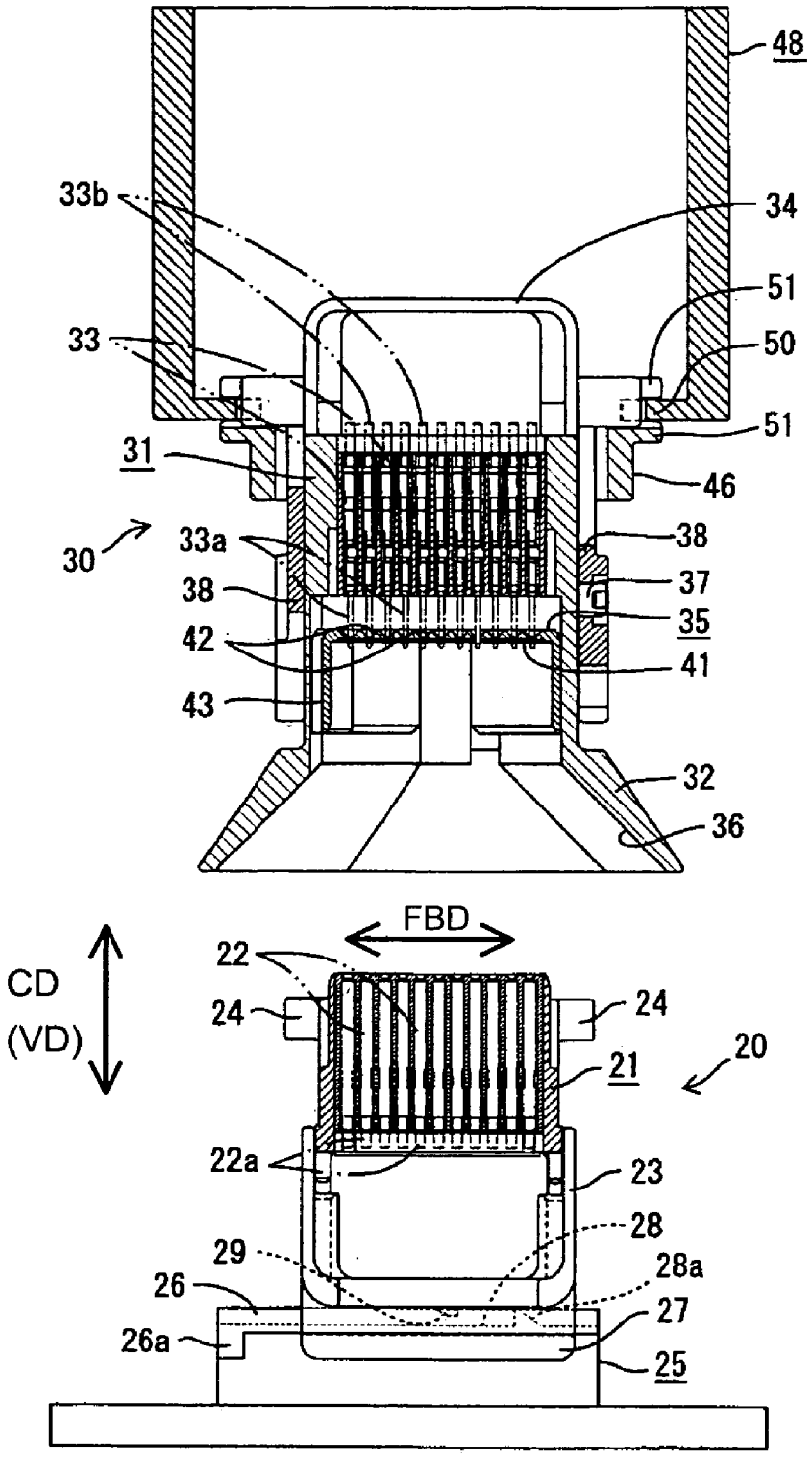
FIG. 4 is a lateral section showing the state before the two connectors are connected.
Figure 5:
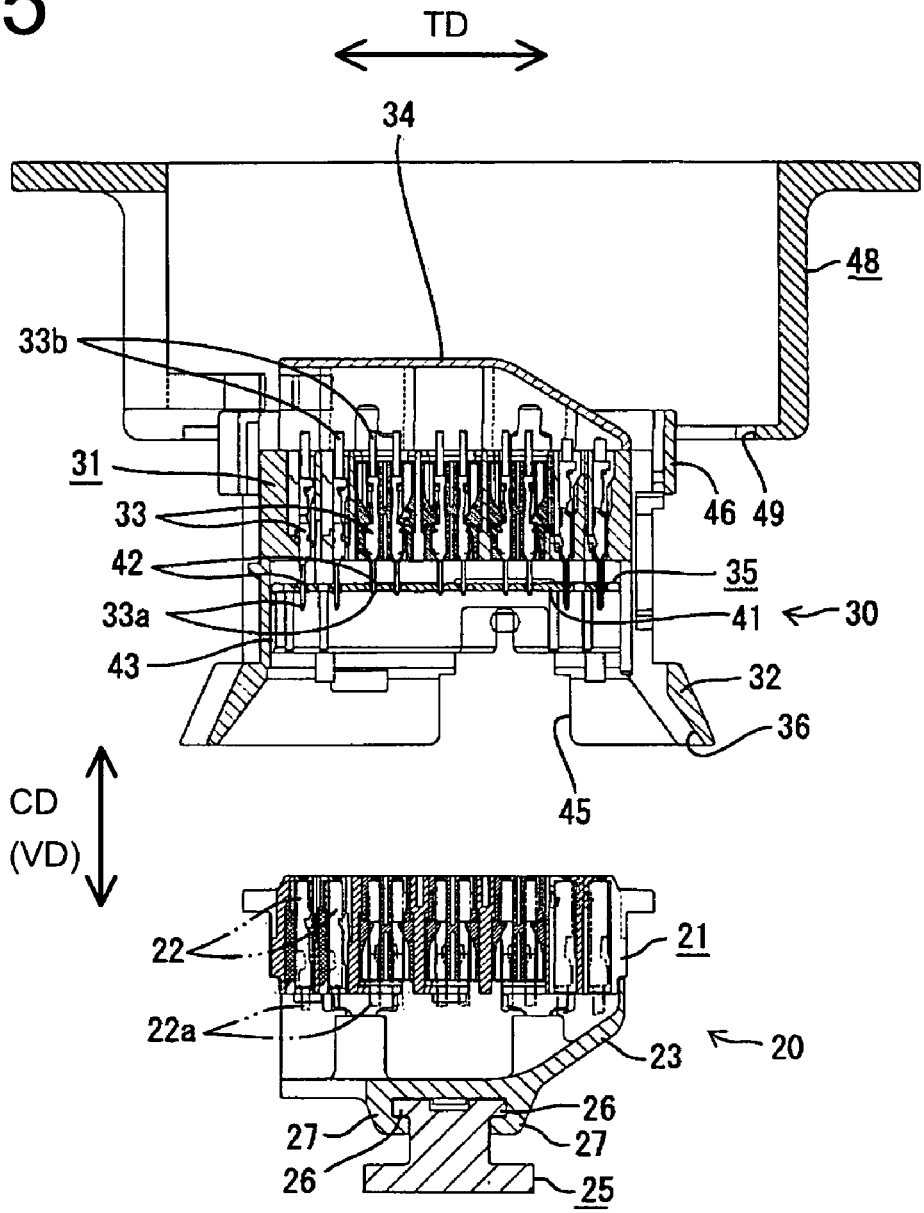
FIG. 5 is a longitudinal section showing the state before the two connectors are connected.
Figure 6:
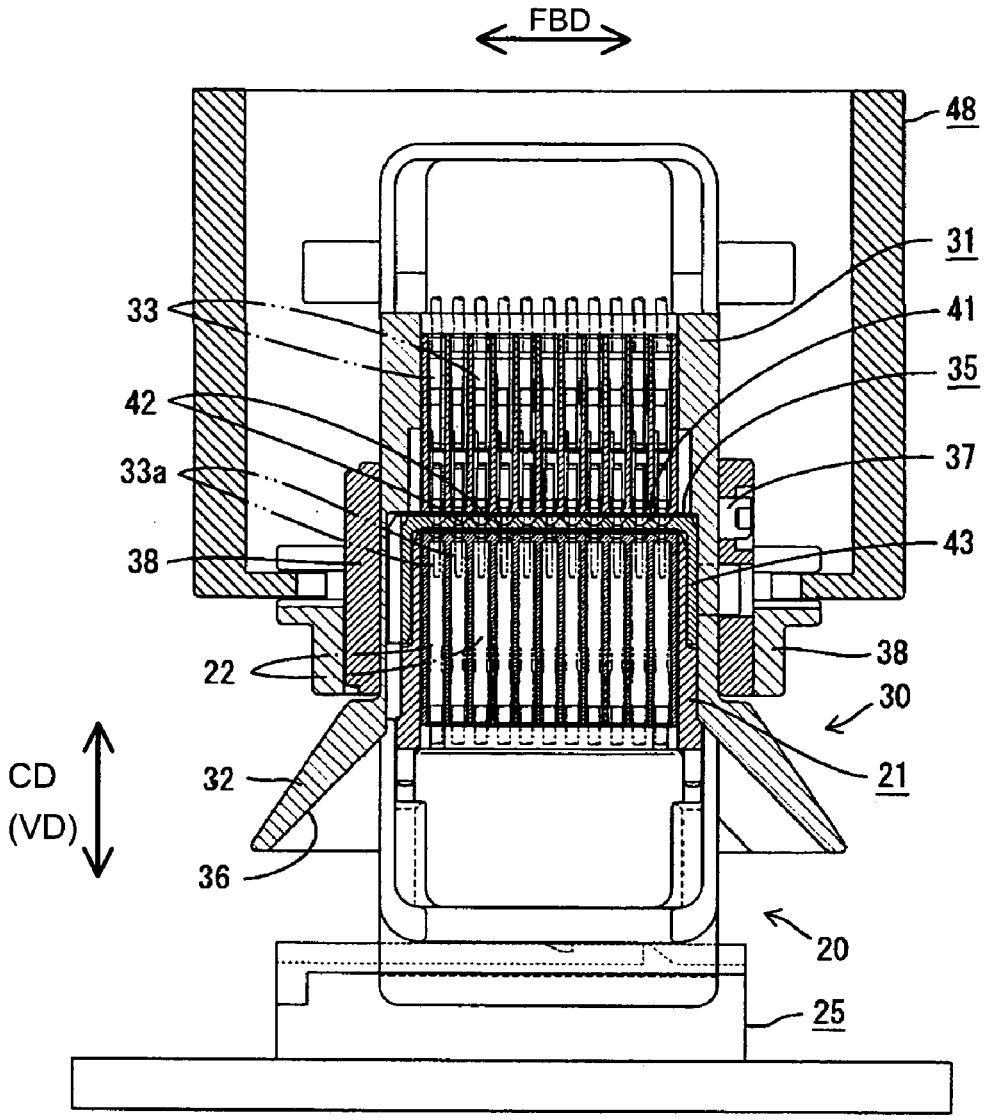
FIG. 6 is a lateral section showing a state where the two connectors are properly connected.
Figure 7:
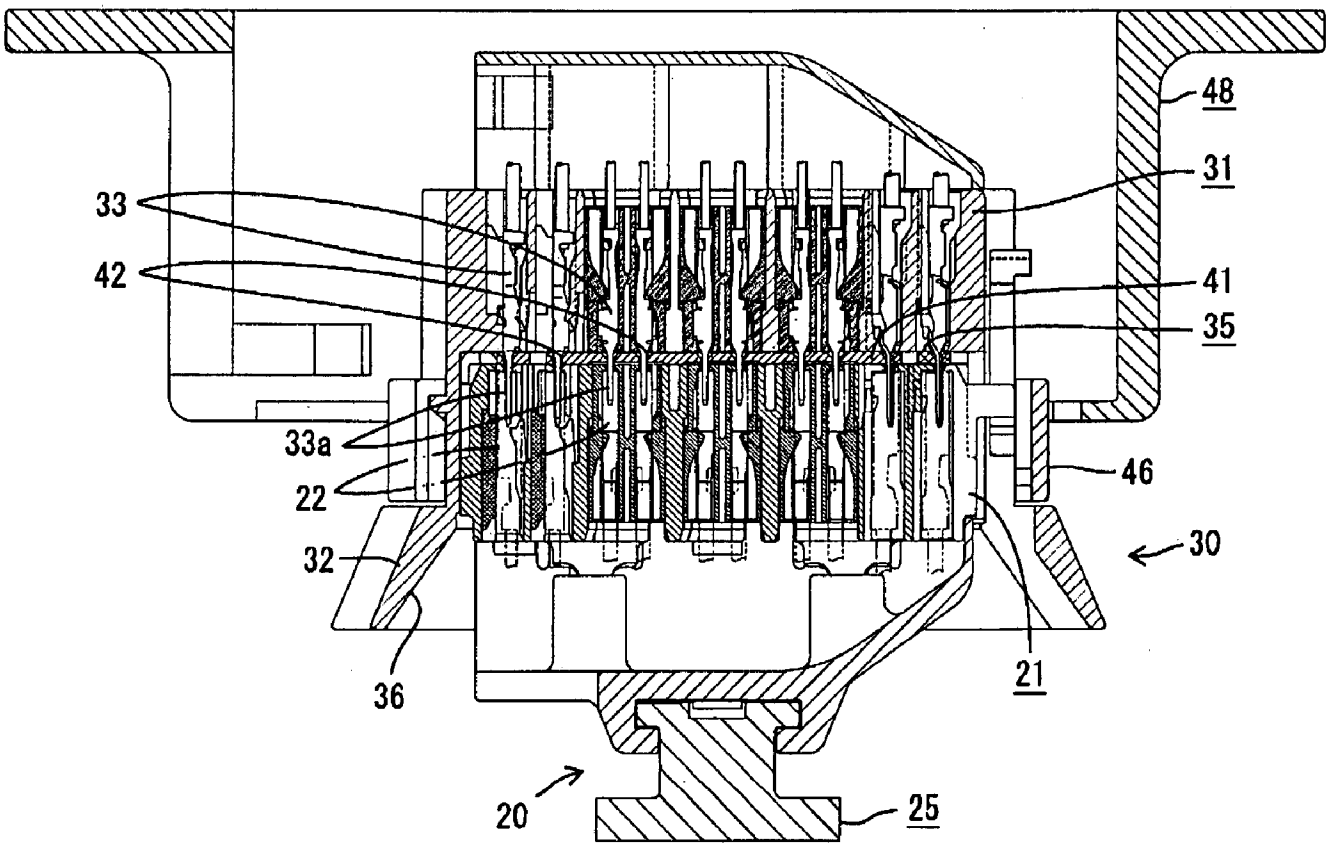
FIG. 7 is a longitudinal section showing the state where the two connectors are properly connected.

One preferred embodiment of the invention is described with reference to FIGS. 1 to 11. According to this embodiment, a module "m" such as an instrument panel is to be assembled with a body "b" in an automotive vehicle. A moving-side connector 30 is on the module "m" and is to be connected with a waiting-side connector 20 on the body "b". In the following description, right and left sides in FIGS. 4 and 6 are referred to respectively as the front and rear sides concerning forward and backward directions FBD. Reference is made to FIGS. 3, 5 and 7 concerning the transverse direction TD, and reference is made to all the figures except FIG. 3 concerning the vertical direction VD. In FIGS. 1 and 9 to 11, a bracket 25 of the body "b" is not shown.

Figure 8A:
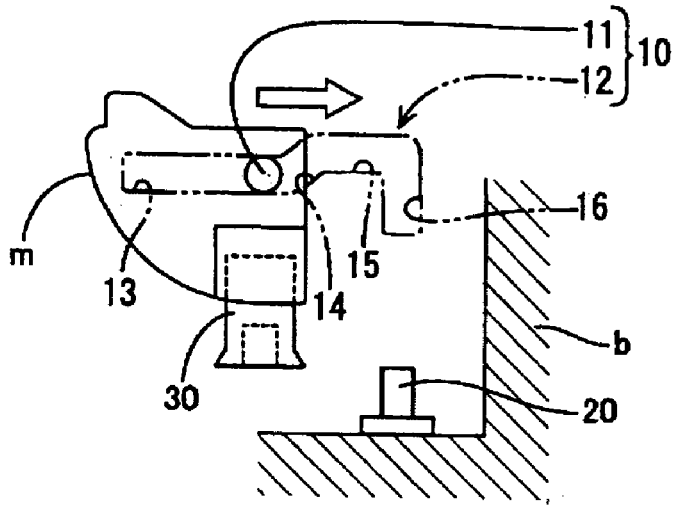
FIGS. 8(*a*), 8(*b*) and 8(*c*) are schematic side views respectively showing a state where a module and the moving-side connector are behind the waiting-side connector, a state where the moving-side connector is right above the waiting-side connector and a state where the moving-side connector is connected with the waiting-side connector as the module is lowered.
Figure 8B:
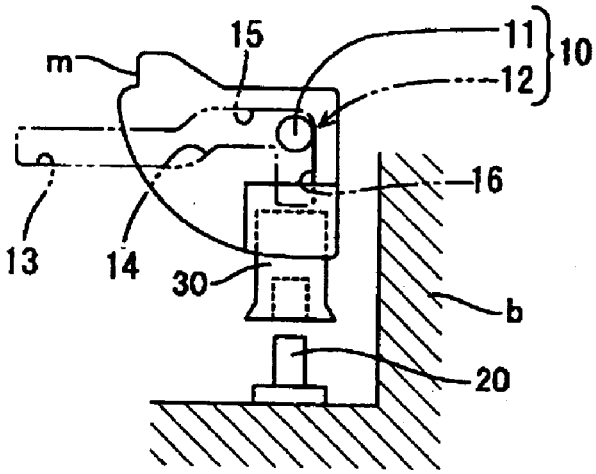
Figure 8C:
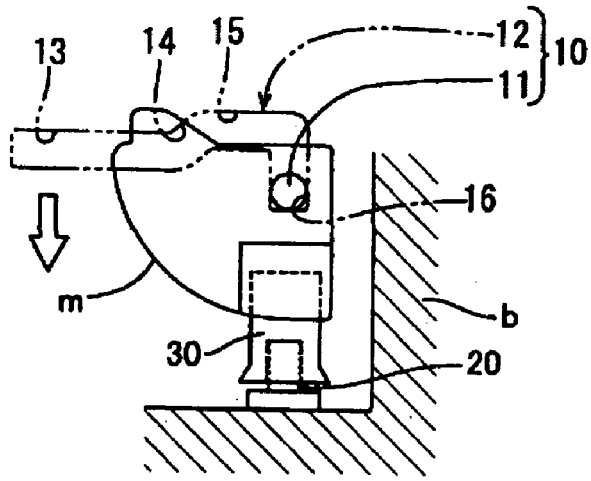

As shown in FIGS. 8(*a*) to 8(*c*), the module "m" is guided substantially horizontally forward by a guiding means 10 for assembling the module "m" with the body "b". The guiding means 10 includes guidable portions 11 on left and right surfaces of the module "m" and a guide rail 12 on an unillustrated assembly line for the module "m". The guide rail 12 has a rear horizontal guide 13, a slanted guide 14, a front horizontal guide 15 and a downward guide 16. The rear horizontal guide 13 extends substantially straight and horizontally along forward and backward directions FBD. The slanted guide 14 extends obliquely up and to the front from the front end of the rear horizontal guide 13, and the front horizontal guide 15 extends forward substantially straight along the horizontal direction from the front end of the slanted guide 14. The downward guide 16 extends down from the front end of the front horizontal guide 15. The module "m" and the moving-side connector 30 are movable substantially forward along the guide rail 12 by engaging the guidable portions 11 with the respective guide rail 12. An operator preferably pushes the module "m" by hand. It should be noted that an unillustrated crane suspends the module "m", and the crane is detached from the module "m" after the module "m" is assembled with the body "b" and the moving-side connector 30 is connected with the waiting-side connector 20.

Figure 1:
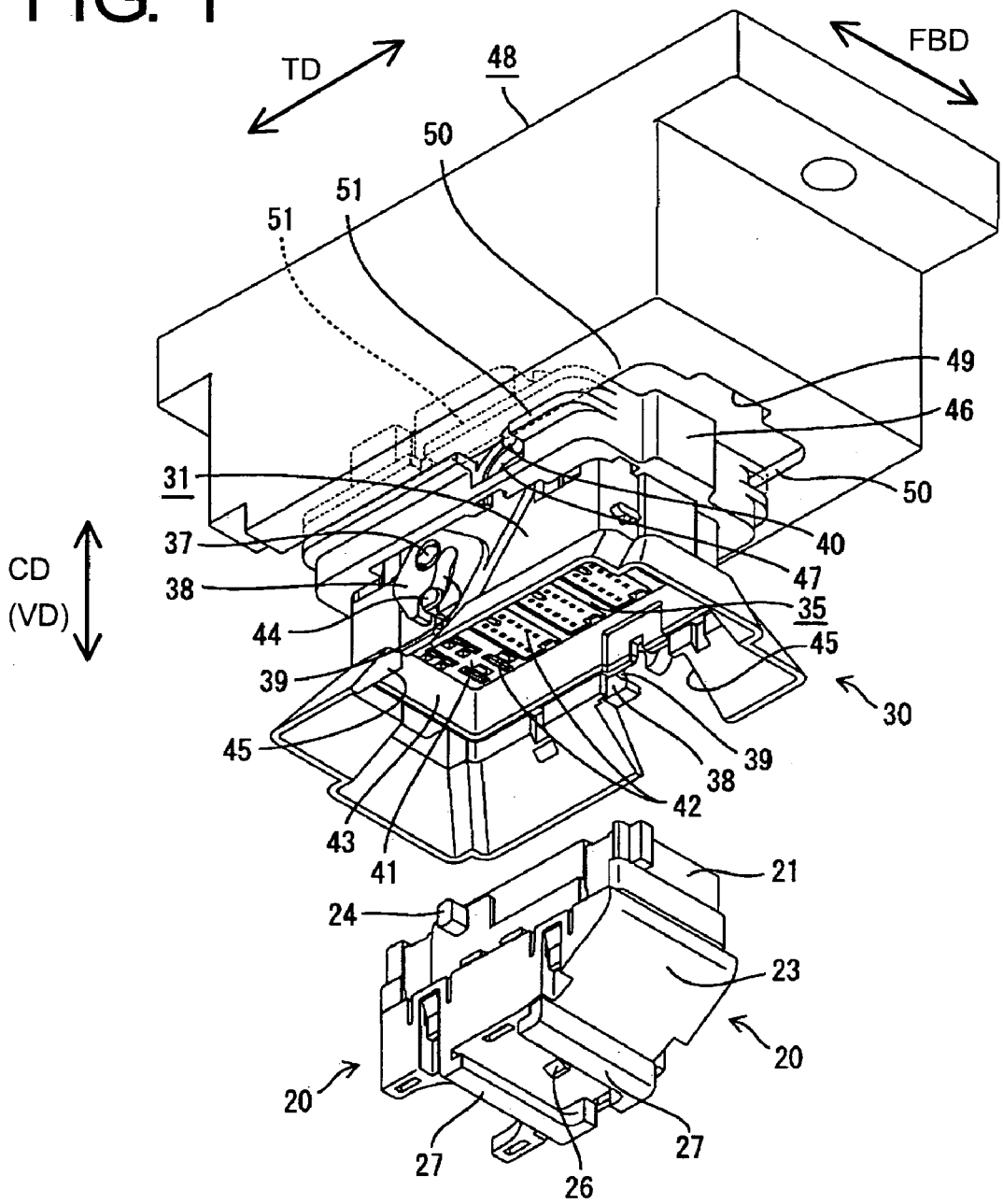
FIG. 1 is a perspective view showing a state before a moving-side and a waiting-side connectors according to the invention are connected.
Figure 2:
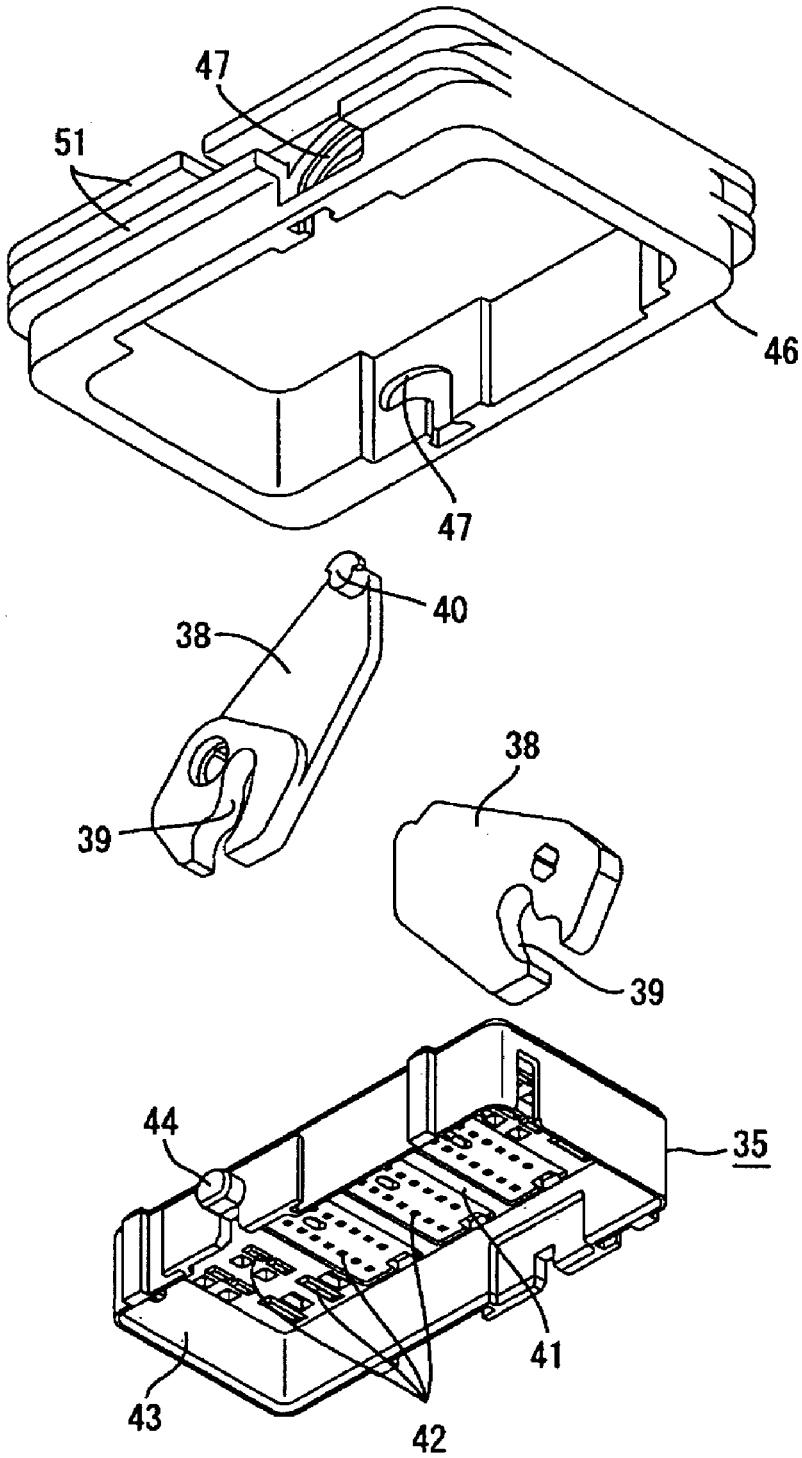
FIG. 2 is an exploded perspective view showing a moving plate, levers and a frame.

As shown in FIGS. 1, 4 and 5, the waiting-side connector 20 is a female connector and has a housing 21 in the form of a wide block with its longitudinal direction aligned along a transverse direction TD. Female terminal fittings 22 are insertable into the housing 21 from below, and a wire cover 23 is mountable at the bottom side of the housing 21. A cam pin 24 projects from each of the outer front and rear surfaces of the housing 21. The respective female terminal fittings 22 are connected with ends of wires 22*a* that are introduced downward through the bottom surface of the housing 21, and drawn to the outside while being bent substantially normal to extend substantially horizontally in the wire cover 23.

The waiting-side connector 20 is to be mounted on the bracket 25 fixed to the body "b". Two guide rails 26 bulge out to the left and right at the upper end of the bracket 25, and guidable portions 27 project from the bottom surface of the wire cover 23. The guidable portions 27 are fit to the guide rails 26. Thus, the waiting-side connector 20 is supported on the bracket 25 to slide along forward and backward directions FBD. Rear restricting portions 26*a* are provided at the rear ends of the guide rails 26 and engage the rear edges of the guidable portions 27. A groove 28 is formed in the upper surface of the bracket 25 and a front restricting portion 28*a* is provided in the groove 28. The front restricting portion 28*a* is engageable with a front engaging portion 29 that projects from the bottom surface of the wire cover 23 to define a slidable area of the waiting-side connector 20 along forward and backward directions FBD.

As shown in FIGS. 1 to 5, the moving-side connector 30 is a male connector and has a housing 31 with a substantially rectangular receptacle 32 that opens forward toward the waiting side connector 20. Male terminal fittings 33 are insertable into the housing 31 from above, and a wire cover 34 is mountable on the upper surface of the housing 31. A moving plate 35 is mountable in the receptacle 32 and is movable vertically along a connecting direction CD.

The male terminal fittings 33 have tabs 33*a* that are electrically connectable with the corresponding female terminal fittings 22. The tabs 33*a* project into the receptacle 32 when the male terminal fittings 33 are accommodated in the housing 31. The respective male terminal fittings 33 are connected with ends of wires 33*b* that are drawn out to the outside and bent substantially normal to extend substantially horizontally in the wire cover 34.

An upper part of the receptacle 32 is a substantially rectangular tube into which the moving plate 35 is fittable, whereas a lower part of the receptacle 32 is widened to increase an opening area toward the waiting side connector 20. A guiding surface 36 is defined at the inner periphery of the lower part of the receptacle 32 and is aligned oblique to vertical direction VD (connecting direction CD). The peripheral edge of the upper surface of the waiting-side connector 20 slides in contact with the guiding surface 36 if the two connectors 20, 30 are misaligned along the transverse direction TD and/or the forward and backward directions FBD. Thus, the guiding surface 36 guides the connecting surfaces of the two connectors 20, 30 into proper alignment.

Supporting shafts 37 project from the opposite front and rear outer surfaces of the housing 31 for rotatably supporting a pair of levers 38. The supporting shafts 37 are displaced transversely from the centers on the front and rear outer surfaces of the housing 31. Both levers 38 have substantially identical long narrow flat-plate shapes. The levers 38 are mounted in transversely opposite postures and are rotatable in opposite directions (see FIG. 2). A cam groove 39 is formed at the bottom end of each lever 38 and has open bottom, front and rear ends. Each cam groove 39 has an arcuate form to gradually approach the supporting shaft 37 from the entrance side toward the backside. A cam pin 40 projects forward or backward at the front or rear outer surface of the upper end of each lever 38.

The moving plate 35 is substantially in the form of a box with an open bottom end, and the front half of the waiting-side connector 20 is fittable into the moving plate 35 from below. The moving plate 35 has an upper wall 41 that faces the back surface of the receptacle 32 and the upper surface of the waiting-side connector 20. The upper wall 41 has positioning holes 42 that receive the respective tabs 33*a* of the male terminal fittings 33 and position the tabs 33*a* in the receptacle 32 with respect to forward backward directions FBD and/or transverse directions TD. The moving plate 35 is movable up and down along the connecting direction CD so that a surrounding wall 43 of the moving plate 35 slides in contact with the inner peripheral surface of the receptacle 32. Cam pins 44 project from the opposite front and rear outer surfaces of the moving plate 35 and engage the cam grooves 39 of the levers 38. Accordingly, the moving plate 35 is displaced up and down in the receptacle 32 along the connecting direction CD by rotating the levers 38 while the cam pins 44 are engaged in the cam grooves 39. The cam pin 44 has a length to project further forward or backward from the outer side surface of the receptacle 32 through a corresponding escape groove 45 in the receptacle 32. The escape grooves 45 have open bottom, front and/or rear ends. A recess 44*a* is formed at the inner side of each cam pin 44 for receiving the corresponding cam pin 24 of the waiting-side connector 20. Accordingly, the cam pins 24 of the waiting-side connector 20 engage the cam grooves 39 via the cam pins 44 of the moving plate 35. Also, the cam pins 24 of the waiting-side connector 20 can enter the escape grooves 45 from below.

The moving-side connector 30 is to be mounted on a frame 46 via both levers 38. The frame 46 is substantially rectangular for surrounding the housing 31 at the front, rear, left and right sides. The moving-side connector 30 is held to make substantially no loose horizontal movement along forward backward directions FBD and transverse directions TD. However, the moving-side connector 30 is movable along the connecting direction CD (substantially vertical direction VD). The frame 46 is formed with front and rear arcuate cam grooves 47, and the cam pins 40 of the levers 38 are engageable with the cam grooves 47. The levers 38 rotate about the supporting shafts 37 as the cam pins 40 of the levers 38 slide to the backs of the cam grooves 47 of the frame 46. A distance from the center of rotation of the lever 38 to the cam pin 40 exceeds a maximum distance from the center of rotation of the lever 38 to the cam groove 39. Thus, movement of the housing 31 along the connection direction CD relative to the frame 46 creates large moments about the centers of rotation of the levers 38 due to the engagement of the cam pins 40 of the levers 38 and the cam grooves 47 of the frame 46. These moments give large pushing/pulling forces along the connection direction CD to the cam pins 44 of the moving plate 35 and the cam pins 24 of the waiting-side connector 20 engaged with the cam grooves 39 of the lever 38.

The moving-side connector 30 is moved down substantially along the connecting direction CD relative to the frame 46. Thus, the cam pins 40 of the levers 38 catch the edges of the cam grooves 47 of the frame 46 when the cam pins 44, 24 of the moving plate 35 and the waiting-side connector 20 are near the entrances of the cam grooves 39 of the levers 38. Accordingly, the moving-side connector 30 is supported and further downward movement is prevented.

The moving-side connector 30 is mounted on a bracket 48 fixed to the module "m". An opening 49 is formed at the bottom end of the bracket 48, and has open upper, bottom and left ends. Guide rails 50 are formed at the front and rear edges of the opening 49. Two guidable portions 51 are provided on ends of the front and rear outer surfaces of the frame 46 and are fit to hold the corresponding guide rail 50 from above and below. Thus, the moving-side connector 30 and the frame 46 are supported to slide transversely with respect to the bracket 48. Further, as shown in FIG. 3, a cut 52 is formed in each guide rail 50 and has an open left end. A right restricting portion 54 is formed at the right edge of the cut 52 and is engageable with right engaging portions 53 on the front and/or rear outer surfaces of the wire cover 34. Two left restricting portions 56 are cantilevered at the left end of the opening 49 of the bracket 48 for engaging left engaging portions 55 at left ends of the front and rear outer surfaces of the wire cover 34. In this way, a slidable area of the moving-side connector 30 is defined substantially along the transverse direction TD.

The waiting-side connector 20 is assembled by inserting the female terminal fittings 22 into the housing and mounting the wire cover 23 on the housing 21. In this state, the waiting-side connector 20 is mounted on the bracket 25 of the body "b" from the front while the guidable portions 27 are slid on the guide rails 26. Thus, the waiting-side connector 20 is supported with the connecting surface thereof faced up along the connecting direction CD.

The moving-side connector 30 is assembled by inserting the male terminal fittings 33 into the housing 31 and mounting the wire cover 34 on the housing 31. The moving-side connector 30 is moved down along the connecting direction CD relative to the frame 46. Thus, the cam pins 44 of the moving plate 35 are located at the entrances of the cam grooves 39 of the levers 38. In this state, the upper wall 41 of the moving plate 35 is spaced from the back surface of the receptacle 32 by a distance corresponding to a connection stroke of the two connectors 20, 30. Additionally, the leading ends of the tabs 33*a* are introduced through the positioning holes 42 to position the tabs 33*a* along forward backward directions FBD and transverse directions TD. The mount position of the moving plate 35 at this time is referred to as an initial position. The frame 46 is mounted together with the moving-side connector 30 into the opening 49 of the bracket 48 of the module "m" in this state while the pairs of the guidable portions 51 are slid along the corresponding guide rails 50. Thus, the moving-side connector 30 is supported with the connecting surface thereof faced down along the connecting direction CD.

The two connectors 20, 30 are connected by engaging the guidable portions 11 of the module "m" with the rear horizontal guide 13 of the guide rail 12. The module "m" then is pushed forward toward the body "b". As a result, the module "m" is moved horizontally forward along the rear horizontal guide 13, as shown in FIG. 8(*a*). The module "m" then is moved obliquely up to the front along the slanted guide 14 and then is moved horizontally along the front horizontal guide 15. When the guidable portions 11 reach the front end of the front horizontal guide 15, the moving-side connector 30 reaches a position right above and facing the waiting-side connector 20 (see FIG. 8(*b*)) and, immediately thereafter, the module "m" is moved down in the connecting direction CD along the downward guide 16 at least partly by the action of gravity (see FIG. 8(*c*)). The moving-side connector 30 is connected with the waiting-side connector 20 as the module "m" is lowered.

Figure 9:
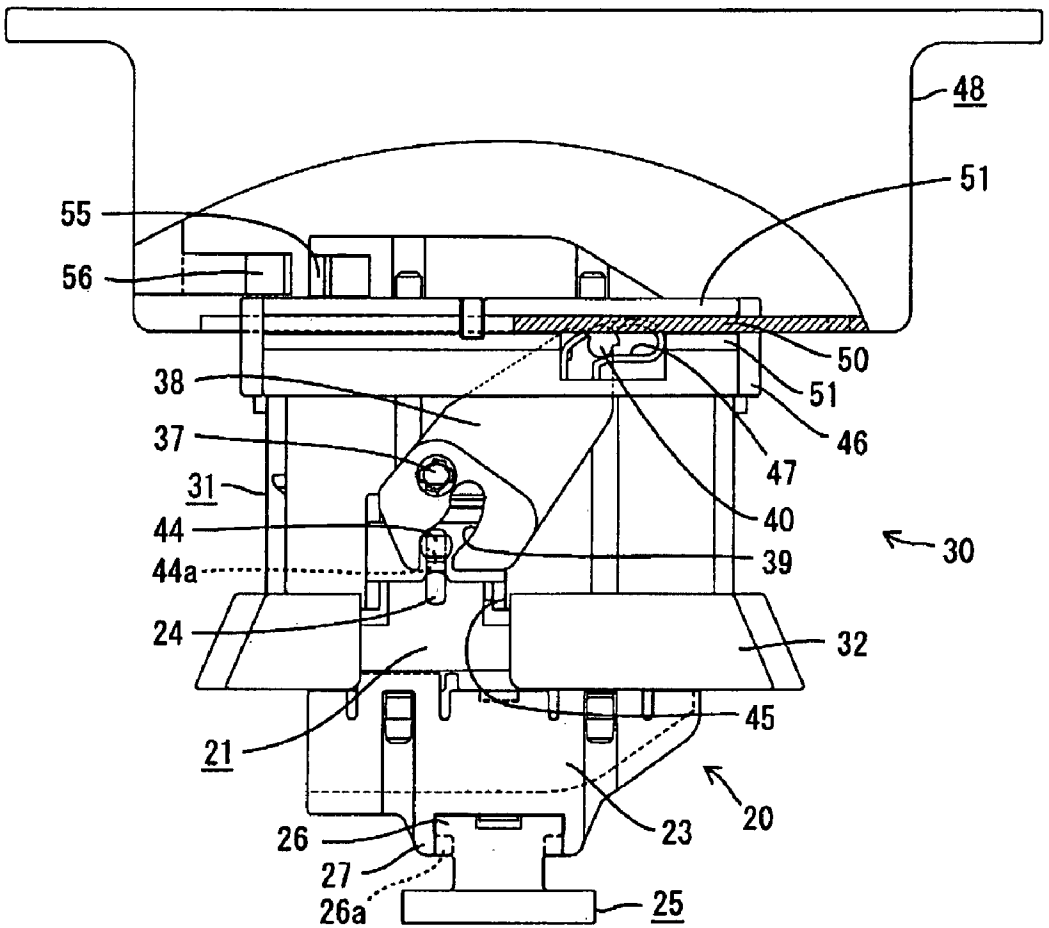
FIG. 9 is a front view partly in section of a state where connection of the moving-side connector with the waiting-side connector is started.
Figure 10:
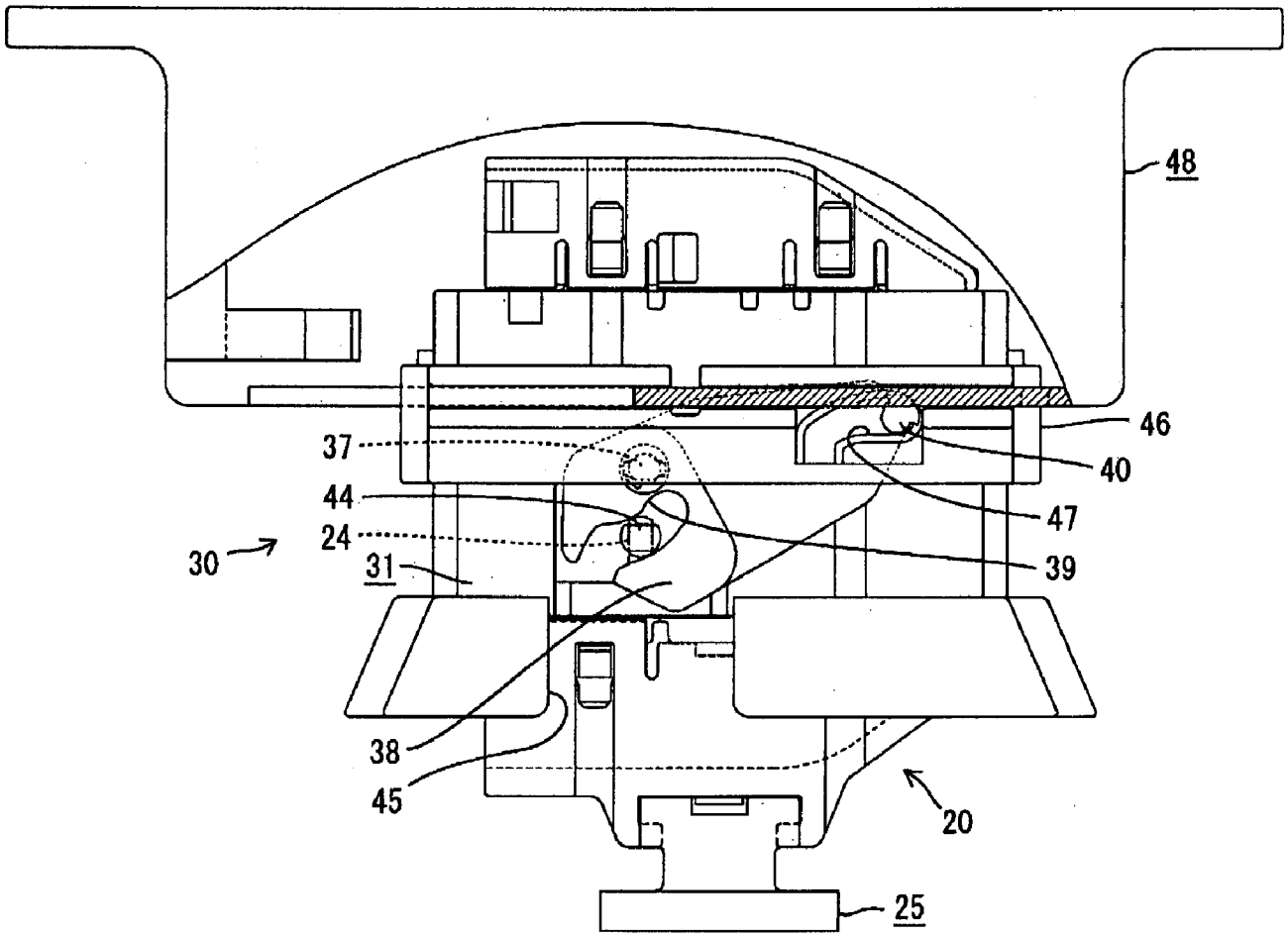
FIG. 10 is a front view partly in section showing an intermediate stage of the connection of the moving-side connector with the waiting-side connector.
Figure 11:
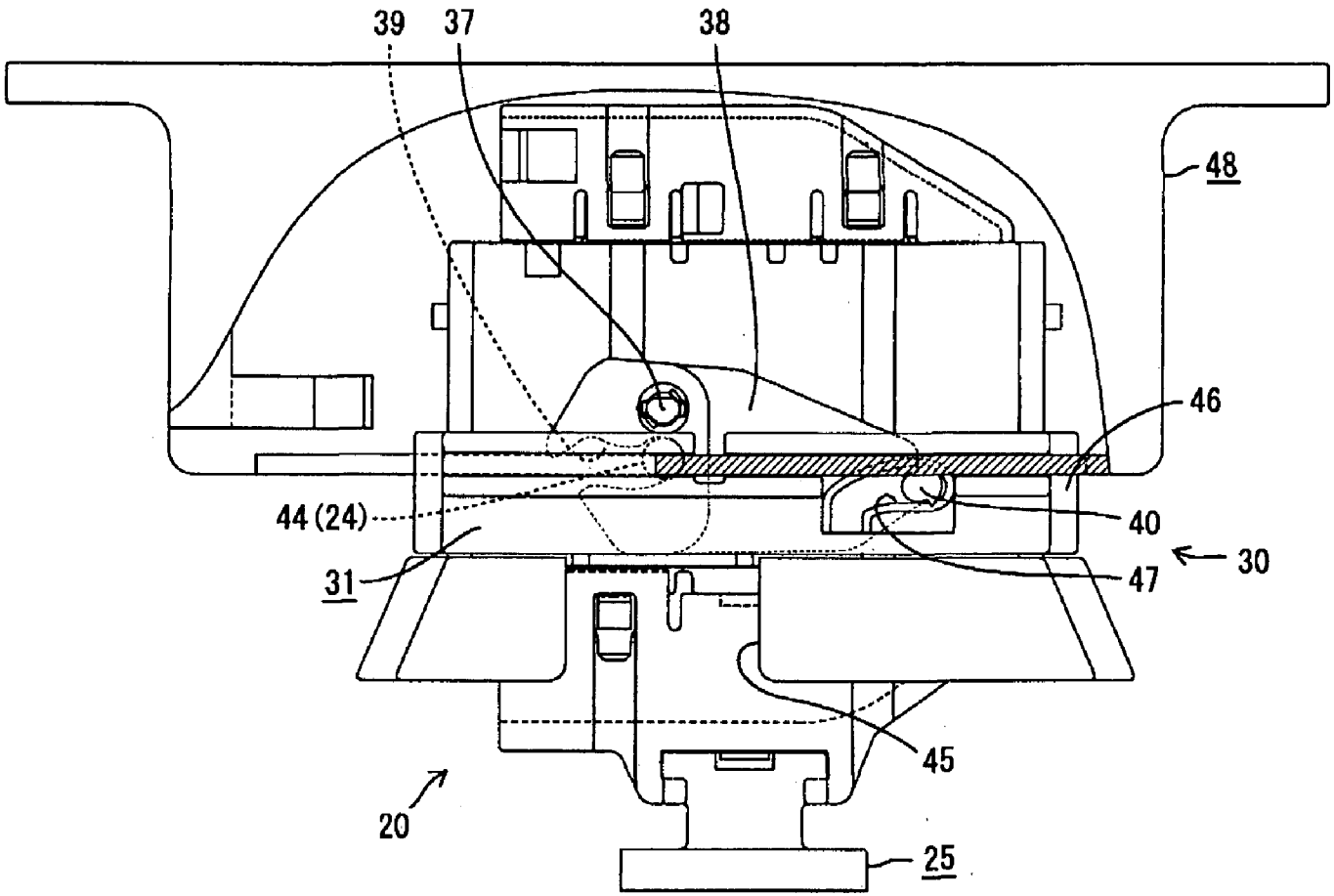
FIG. 11 is a front view partly in section of a state where connection of the moving-side connector with the waiting-side connector is completed.

The moving-side connector 30 is lowered in a state shown in FIGS. 4 and 5. As a result, the receptacle 32 is fit to the waiting-side connector 20 from above and substantially along the connecting direction CD. The cam pins 24 of the waiting-side connector 20 fit into the recesses 44*a* of the cam pins 44 of the moving plate 35 when the receptacle 32 starts being fit to the waiting-side connector 20. Thus, the cam pins 24, 44 are united, as shown in FIGS. 9 and 10. A connection resistance then acts between the two connectors 20, 30 to displace the moving-side connector 30 up along the connecting direction CD relative to the frame 46. The cam pins 40 of the levers 38 are engaged with the cam grooves 47 of the frame 46 and slide towards the backsides of the cam grooves 47. As a result, the levers 38 rotate and create a cam action as the cam pins 40 move towards the backsides of the cam grooves 47. Thus, the waiting-side connector 20 and the moving plate 35 are pulled up along the connecting direction CD toward the moving-side connector 30 and the tabs 33*a* of the respective male terminal fittings 33 start being brought smoothly into contact with the corresponding female terminal fittings 22.

When the two connectors 20, 30 are connected properly (see FIGS. 6, 7 and 11), the tabs 33*a* of the male terminal fittings 33 are connected properly with the corresponding female terminal fittings 22 and the moving plate 35 is displaced up to a connecting position where the upper wall 41 of the moving plate 40 is held in contact with both the back surface of the receptacle 32 and the upper surface of the housing 21 of the waiting-side connector 20. Thereafter, the connectors 20, 30 and the module "m" are moved horizontally forward together relative to the body "b". By this movement, the module "m" reaches a substantially proper assembled position with the body "b". Upon moving the two connectors 20, 30 and the module "m" forward, the guidable portions 27 slide along the guide rails 26 of the bracket 25 of the body "b".

The two connectors 20, 30 may have to be detached for maintenance or other reason. In such a case, the module "m" is lifted from the connected state. Thus, the moving-side connector 30 is displaced down along the connecting direction CD relative to the frame 46 due to a frictional resistance between the connectors 20, 30 and the levers 38 are rotated in directions opposite from their direction of rotation during connection of the two connectors 20, 30. As a result, the cam pins 40 of the levers 38 are slid towards the entrances of the cam grooves 47. A cam action is exhibited as the levers 38 are rotated due to the sliding movement of the cam pins 24, 44 towards the entrances of the cam grooves 39, and the cam action pushes the waiting-side connector 20 and the moving plate 35 down. As a result, the respective female terminal fittings 22 start being separated from the tabs 33*a* of the corresponding male terminal fittings 33. The levers 38 are rotated to the connecting positions to bring the cam pins 24, 44 to the entrances of the cam grooves 39. Thus, the cam pins 40 of the levers 38 catch the edges of the cam grooves 47 of the frame 46, and only the waiting-side connector 20 is separated down from the moving-side connector 30 (see FIG. 9). At this time, the moving plate 35 is pushed to the same initial position that existed before the two connectors 20, 30 are connected, and the leading ends of the tabs 33*a* remain in the positioning holes 42. Accordingly, when the two connectors 20, 30 are connected again after completion of maintenance, the tabs 33*a* of the respective male terminal fittings 33 are positioned by the moving plate 35 held at the initial position. Therefore, the connecting operation can be performed without vertically adjusting the position of the moving plate 35.

As described above, the tabs 33*a* of the male terminal fittings 33 are positioned properly by the moving plate 35 beforehand and hence can be connected properly with the mating female terminal fittings 22. Further, the moving plate 35 is moved forward and back along the connecting direction CD in the receptacle 32 as the levers 38 are rotated. Thus, the moving plate 35 is pushed to the position that existed before the connection as the levers 38 are rotated in reverse directions during separation of the connectors 20, 30. Thus, the moving plate 35 need not be positioned vertically when the connecting operation is performed again, thereby presenting a good operability.

Further, the supporting shafts 37 for the levers 38 are at the positions on the lever-mounting surfaces of the housing 31 displaced from the middle along the direction substantially normal to the connecting direction CD. Thus, the length of the levers 38, i.e. the distance from the supporting shafts 37 to the cam pins 40 is large as compared, for example, to a case where supporting shafts are at middle positions of lever-mounting surfaces of a housing with respect to a direction substantially normal to a connecting direction. Therefore, a force required to rotate the levers 38, i.e. a force required to connect the two connectors 20, 30 can be reduced.

The invention is not limited to the above-described embodiment. For example, the following embodiments also are embraced by the invention as defined by the claims. Various other changes also can be made without departing from the scope and spirit of the invention as defined by the claims.

The cam grooves of the frame have an arcuate form in the foregoing embodiment. However, the cam grooves may be substantially straight and may extend at an angle to the connecting direction CD.

The cam grooves of the frame are the supports and the cam pins of the levers are the supportable portions in the foregoing embodiment. Conversely, cam pins may be provided on the frame as the supports and cam grooves may be formed in the levers as the supportable portions.

The levers are supported on the frame in the foregoing embodiment. However, the frame may be omitted and the levers may be supported on the bracket. In such a case, cam grooves corresponding to the supports may be formed in the bracket.

The two connectors are connected as the module is displaced down in the foregoing embodiment. However, they may be connected, for example, as the module is displaced forward according to the present invention.

Although the moving-side connector is a male connector and the waiting-side connector is a female connector in the foregoing embodiment, the moving-side and waiting-side connectors may be conversely a female connector and a male connector, respectively. Further, an embodiment in which the female connector detached from the module is singly connected with the male connector as the waiting-side connector (fixed to the body "b") is also embraced by the present invention.

What is claimed is:

1. A lever-type connector (30) having a housing (31) for accommodating terminal fittings (33) that can be brought into contact with mating terminal fittings (22), the housing (31) being connectable with a mating housing (21), and at least one lever (38) rotatably supported thereon, comprising:

at least one cam means (39) on the lever (38) for engaging at least one mating cam means (24) on the mating housing (21) and a supportable portion (40) on the lever (38) for slidable support on a supporting portion (47) of a supporting member (46) to permit rotation of the lever (38);

the housing (31) is displaced to approach the supporting member (46) as the housings (31, 21) are connected, and the supportable portion (40) is moved relative to the supporting portion (47) to rotate the lever (38), thereby engaging the cam means (24) with the mating cam means (39) to exhibit a cam action;

a moving plate (35) formed with positioning holes (42) for receiving and positioning the terminal fittings (33), the moving plate (35) being mounted in the housing (31) for movement substantially along a connecting direction (CD).

2. The lever-type connector of claim 1, wherein the moving plate (35) has at least one moving plate cam means (44) for engaging the cam means (39) and moving the moving plate (35) forward and backward in the housing (31) as the lever (38) is rotated.

3. The lever-type connector of claim 1, wherein the housing (31) has a receptacle (32) that substantially surrounds the terminal fittings (33) and into which a mating housing (21) is fittable.

4. The lever-type connector of claim 3, wherein the moving plate (35) is mounted into the receptacle (32) for movement forward and back substantially along a connecting direction (CD).

5. The lever-type connector of claim 1, wherein the cam means (39) for engaging the mating cam means (24) on the mating housing (21) is at one end of the lever (38), and the supportable portion (40) is at an end of the lever (38) opposite the cam means (39).

6. The lever-type connector of claim 1, wherein the housing (31) is displaced to approach the supporting member (46) and the supportable portion (40) is slid on the supporting portion (47) to rotate the lever (38) as the two housings (31, 21) are connected.

7. The lever-type connector of claim 1, wherein a rotary shaft (37) of the lever (38) is at a position on a lever-mounting surface of the housing (31) displaced from a middle along a direction substantially normal to the connecting direction (CD).

8. The lever-type connector of claim 7, wherein a distance from the rotary shaft (37) to the supportable portion (40) exceeds a maximum distance from the rotary shaft (37) to the cam means (39).

9. A lever-type connector (30) comprising:

a frame (46) mounted to a support for movement in a transverse direction (TD), the frame being formed with cam grooves (47);

a housing (31) movable in the frame (46) along a connecting direction (CD) transverse to the transverse direction (TD), the housing (31) having a receptacle (32) and support shafts (37);

terminal fittings (33) having tabs (33*a*) projecting into the receptacle (32);

a moving plate (35) mounted in the receptacle (32) for movement along the connecting direction (CD), the moving plate (35) having positioning holes (42) for receiving and positioning the tabs (33*a*), cam pins (44) projecting from the moving plate (35);

a mating housing (21) connectable with the housing (31) along the connecting direction (CD), cam pins (24) projecting from the mating housing (21) and being engageable with the cam pins (44) of the moving plate (35); and levers (38) rotatable about the support shafts (37) of the housing (31), the levers (38) each having a cam groove (39) engaging the cam pins (24, 44) on the mating housing (21) and on the moving plate (35), the levers (38) further having cam pins (40) engaging the cam grooves (47) in the frame (46), whereby movement of the mating housing (21) and the housing (31) towards one another rotates the levers (38) and generates a cam action between the cam pins (24, 44, 40) and the respective cam grooves (39, 47) for moving the housing (31) relative to the frame (46) and for moving the moving plate (35) and the mating housing (21) relative to the receptacle (32) along the connecting direction (CD).

10. The lever-type connector of claim 9, wherein the cam groove (39) is at one end of each said lever (38), and the cam pin (40) is at an end of the respective lever (38) opposite the cam groove (39).

11. The lever-type connector of claim 10, wherein the support shafts (37) are at positions on a lever-mounting surface of the housing (31) displaced from a middle along a direction substantially normal to the connecting direction (CD).

12. The lever-type connector of claim 11, wherein a distance from the support shaft (37) to the cam pin (40) exceeds a maximum distance from the support shaft (37) to the cam groove (39).

13. The lever-type connector of claim 12, wherein the levers (38) are mounted on opposite respective sides of the housing (31) and are configured to rotate in opposite respective directions during connection and disconnection of the housing (31) and the mating housing (21).

14. The lever-type connector of claim 13, wherein the levers (38) are at non-symmetrical positions on the respective sides of the housing (31).

* * * * *

UNITED STATES PATENT AND TRADEMARK OFFICE

CERTIFICATE OF CORRECTION

PATENT NO. : 6,887,089 B2
DATED : May 3, 2005
INVENTOR(S) : Satoru Nishide

It is certified that error appears in the above-identified patent and that said Letters Patent is hereby corrected as shown below:

Title page,
Item [30], Foreign Application Priority Data, please change to:
-- Jan. 7, 2003 (JP) …….. 2003-001520 --

Signed and Sealed this

Twelfth Day of July, 2005

JON W. DUDAS
*Director of the United States Patent and Trademark Office*